US007260348B2

(12) United States Patent
Matsuzaki

(10) Patent No.: US 7,260,348 B2
(45) Date of Patent: Aug. 21, 2007

(54) IMAGE FORMING APPARATUS HAVING A TONER-SUPPLYING ROLLER AND A DEVELOPING ROLLER CONFIGURED TO MEET A SPECIFIC PARAMETER

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 219 days.

(21) Appl. No.: 10/974,762

(22) Filed: Oct. 28, 2004

(65) Prior Publication Data

US 2005/0100368 A1 May 12, 2005

(30) Foreign Application Priority Data

Nov. 11, 2003 (JP) ..... 2003-380829

(51) Int. Cl.
*G03G 15/08* (2006.01)

(52) U.S. Cl. ..... 399/281; 399/265; 399/279

(58) Field of Classification Search ..... 399/252, 399/265, 279, 281, 286; 430/105, 120
See application file for complete search history.

(56) References Cited

U.S. PATENT DOCUMENTS 4,652,508 A * 3/1987 Ober et al. ..... 430/108.22
5,114,823 A 5/1992 Tomura et al.
5,557,060 A * 9/1996 Okada et al. ..... 399/284
5,862,444 A 1/1999 Machida et al.
5,978,635 A 11/1999 Azuma et al.
6,049,689 A 4/2000 Ishii et al.
6,163,669 A * 12/2000 Aoki et al. ..... 399/265 X
6,178,303 B1 1/2001 Ishii et al.
6,198,893 B1 3/2001 Ichikawa et al.
6,345,166 B1 2/2002 Sakaizawa et al.
6,480,692 B2 * 11/2002 Yamazaki et al. ..... 399/281
6,714,754 B2 * 3/2004 Ozeki et al. ..... 399/286
6,740,463 B2 * 5/2004 Shigemori et al. ..... 430/105 X
6,819,899 B2 * 11/2004 Miyakawa et al. ..... 399/252

FOREIGN PATENT DOCUMENTS

JP 10-239988 9/1998

* cited by examiner

*Primary Examiner*—Sandra L. Brase
(74) *Attorney, Agent, or Firm*—Rabin & Berdo, PC

(57) ABSTRACT

An image-forming apparatus includes a toner-supplying roller and a developing roller that receives toner from the toner-supplying roller, the toner having either a glass transition point not higher than 67° C. or a softening point not higher than 120° C. The developing roller and toner-supplying roller are configured to meet a parameter F given by $1\times10^5<F<7\times10^5$ and $F=\theta\times\delta\times Asp\times(Vsp+Vdv)$ where θ is an angle of slide (degrees) of the developing roller, δis a nip (mm) formed in the toner-supplying roller in contact with the developing roller, Asp is a hardness (degrees) of a surface of the toner-supplying roller, the hardness being measured with an Asker Type F durometer, Vsp is a circumferential speed (mm/sec) of the toner-supplying roller, and Vdv is a circumferential speed (mm/sec) of the developing roller and is higher than 150 mm/sec.

8 Claims, 1 Drawing Sheet

IMAGE FORMING APPARATUS HAVING A TONER-SUPPLYING ROLLER AND A DEVELOPING ROLLER CONFIGURED TO MEET A SPECIFIC PARAMETER

BACKGROUND OF THE INVENTION

1. Field of the Invention

The present invention relates to an electrophotographic image-forming apparatus, and more particularly to a configuration of a toner-supplying roller and a developing roller that receives toner from the toner-supplying roller.

2. Description of the Related Art

A developer (referred to as toner hereinafter) for a conventional electrophotographic image-forming apparatus takes the form of hard, powder particles that are difficult to melt together in a normal storage temperature range. One such toner is manufactured by pulverization and has a particle diameter of about 10 μm. This pulverized toner has a glass transition point Tg higher than 68° C. Thus, pulverized toner is used for its low cost. As the name implies, pulverized toner is manufactured by mechanically pulverizing the toner material. Therefore, the diameter and composition of the toner particles have large variations but could be used without problem when printing is performed at conventional speeds. Another problem is that recent demand for increased printing speed in electrophotography accelerates wear of developing rollers. In order to solve this problem, the amount of nip formed between a developing roller and a toner-supplying roller is increased, thereby controlling the ratio of the circumferential speed of the toner-supplying roller to that of the developing roller to be lower than a predetermined value.

If a conventional electrophotographic image-forming apparatus uses the conventional pulverized toner and operates to print at a higher speed than conventional, a fixing unit requires a larger electric power to fuse a hard-to-melt toner. Greater power consumption generates more heat, requiring efficient heat dissipation. This would result in a larger overall apparatus size. However, there have been strong demands in the field of recent image forming apparatus towards higher printing speed, less power consumption, and miniaturization of apparatus. Conventional image-forming apparatus may be increased in printing speed at the expense of greater power consumption, but are difficult to address the problem of saving electric power and miniaturizing the image-forming apparatus.

For example, a conventional image-forming apparatus requires a developing roller to rotate at a circumferential speed in the range of 70 to 150 mm/sec. Recently, a developing roller is required to rotate at a speed higher than 150 mm/sec. In addition, because the conventional hard-to-melt toner is an obstacle to saving electric power and miniaturizing the image forming apparatus, a low melting point toner has come into use for less power consumption in the fixing processing. A lower melting point toner has either a glass transition point lower than 67° C., or a softening point Ts lower than 80° C. and a fluid point Tfb lower than 120° C. Tfb is a temperature at which the flowing of the toner begins. However, if such a low melting point toner is used with a developing roller rotating at a circumferential speed higher than 150 mm/sec, the toner melts due to the heat created by the friction between the developing roller and the toner-supplying roller and is deposited on the developing roller.

SUMMARY OF THE INVENTION

The present invention was made to solve the aforementioned problems. An object of the invention is to provide an image forming apparatus that has a small overall size and uses a low melting point toner.

An image-forming apparatus comprising:

a toner-supplying roller that rotates;

a developing roller that rotates in contact with the toner-supplying roller and receives toner from the toner-supplying roller, the toner having either a glass transition point not higher than 67° C. or a softening point not higher than 120° C.;

wherein the developing roller and the toner-supplying roller are configured to meet a parameter F such that $$1\times10^5<F<7\times10^5 \text{ and } F=\theta\times\delta\times Asp\times(Vsp+Vdv)$$

where θ is an angle of slide (degrees) of the developing roller,

δ is a nip (mm) formed in the tone-supplying roller in contact with the developing roller, Asp is a hardness (degrees) of a surface of the toner-supplying roller, the hardness being measured with an Asker Type F durometer, Vsp is a circumferential speed (mm/sec) of the toner-supplying roller, and Vdv is a circumferential speed (mm/sec) of the developing roller and is higher than 150 mm/sec.

The toner is a spherical toner having a glass transition point not higher than 67° C.

The toner is a spherical toner having a softening point not higher than 80° C. and a fluid point not higher than 120° C.

The toner is a pulverized toner having a glass transition point not higher than 67° C., and the parameter F is in the range of $3\times10^5<F<6\times10^5$.

The toner is a pulverized toner having a softening point not higher than 80° C. and a fluid point not higher than 120° C., and the parameter F is in the range of $3\times10^5<F<6\times10^5$.

The toner may be chemically polymerized.

The toner is a capsule type toner in which the toner particles are enclosed in a shell having a higher softening point than the toner particles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

FIRST EMBODIMENT

{Construction}

Figure 1:
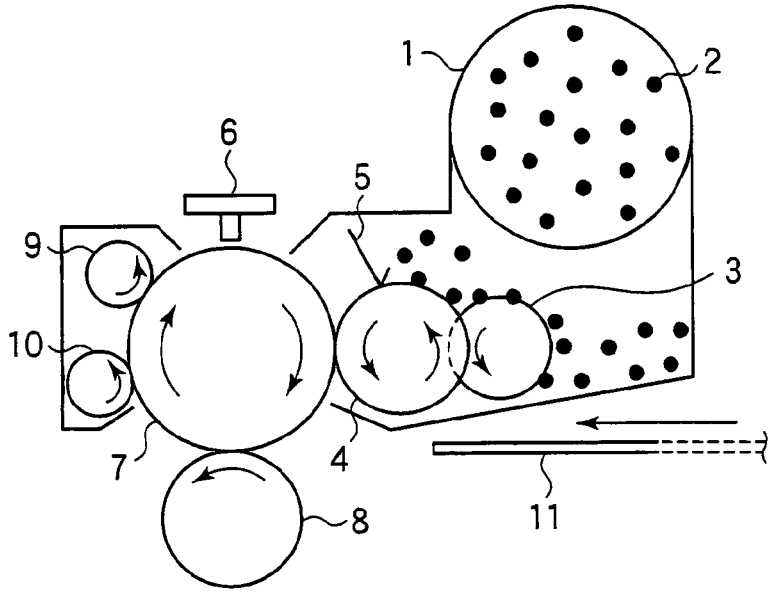
FIG. 1 is a cross-sectional view of a schematic configuration of a developing unit in an electrophotographic image forming apparatus according to a first embodiment.

FIG. 1 is a cross-sectional view of a schematic configuration of a developing unit in an electrophotographic image-forming apparatus according to a first embodiment.

Referring to FIG. 1, a toner cartridge 1 holds toner 2 in powder form. The toner used in the first embodiment is a low melting point toner that has a specified glass transition point Tg. A condition under which toner melts is a combination of the temperature of the toner and the amount of heat applied to the toner. The higher the printing speed, the shorter the time length during which the toner is heated, so that the fixing unit should operate at higher temperature. In other words, the temperature of the fixing unit is not the only factor that defines a low melting point toner. Thus, the low melting point toner according to the first embodiment is defined in terms of glass transition point. The low melting point toner according to a second embodiment is also defined in terms of glass transition point of toner. The low melting point toner according to a third and fourth embodiment is defined in terms of a combination of measure of a softening temperature Ts and a fluid temperature Tfb of toner.

Melting point is a temperature at which a crystallized portion of a polymer breaks to exhibit fluidity (melt). An amorphous portion of a polymer is in a glassy state at low temperature and in a rubbery state at high temperature due to the fact that molecules become easy to move. Glass transition point Tg is a temperature at which a polymer transits from a glass state to a rubbery state. One well-known example of glass transition point Tg is a temperature of about 30° C. at which vinyl accetate, a base material of chewing gum, changes into a glass state. More specifically, a piece of chewing gum is hard before it is chewed in a mouth but becomes soft after it is chewed.

A developing blade 5 limits the thickness of the toner layer formed on a developing roller 4, thereby forming a thin layer of toner. An LED head 6 is an exposing head having light-emitting diodes (LEDs) aligned along the rotational axis of a photoconductive drum 7. The photoconductive drum 7 is in the shape of a drum having a photoconductive material coated on its cylindrical surface. The LED head 6 illuminates a charged surface of the photoconductive drum 7 to form an electrostatic latent image.

A sponge roller 3 is a roller having a cylindrical surface formed of a resilient material such as sponge and the toner 2 is deposited on the cylindrical surface. The developing roller 4 rotates in contact with the sponge roller 3 in such a way that the developing roller 4 and sponge roller 3 rotate in opposite directions to form a toner layer on the developing roller. The developing roller 4 applies the toner 2 to the electrostatic latent image formed on the photoconductive drum 7 to develop the electrostatic latent image with the toner 2 into a toner image.

A transfer roller 8 transfers the toner image onto a later-described print medium 11. A charging roller 9 charges the entire surface of the photoconductive 7 uniformly. A cleaning roller 10 scratches off residual toner from the photoconductive drum 7 after transferring the toner image onto the print medium 11. The print medium 11 is a medium such as paper and OHP on which a toner image is transferred.

The sponge roller 3, developing roller 4, transfer roller 8, charging roller 9 and cleaning roller 10 have gears, not shown, which are, for example, press-fitted to one end of the respective rollers. Drive forces are transmitted to these rollers through the gears.

The sponge roller 3, developing roller 4, transfer roller 8, charging roller 9, cleaning roller 10, and LED head 6 receive bias voltages from corresponding high-voltage power supplies, not shown, controlled by a controller, not shown.

The toner 2 falls gradually from the toner cartridge 1 and is stored around the sponge roller 3. Then, the toner 2 is deposited on the sponge roller 3 and transferred from the sponge roller 3 to the developing roller 4 to form a toner layer on the developing roller 4. The developing roller 4 deposits the toner 2 to the electrostatic latent image formed on the photoconductive drum 7 to develop the electrostatic latent image with the toner 2 into a toner image. The toner image is transferred onto the print medium 11.

Both the developing roller 4 and sponge roller 3 have a circumferential surface made of a soft resilient material such as sponge. The sponge roller 3 is pressed against the developing roller 4 in such a way that the sponge roller 3 is dented.

Figure 2:
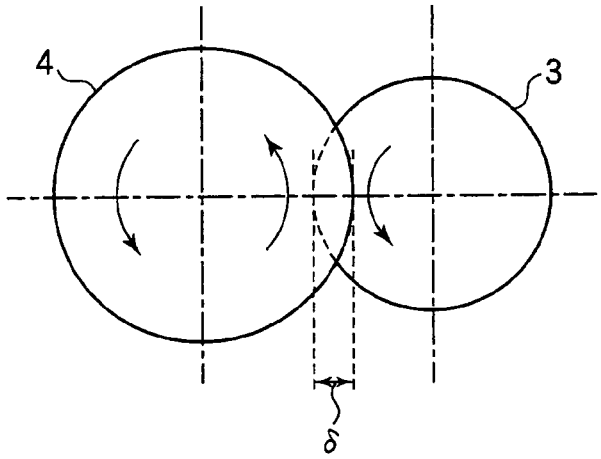
FIG. 2 is an enlarged cross-sectional side view illustrating the sponge roller and developing roller.

FIG. 2 is an enlarged cross-sectional side view illustrating the sponge roller 3 and developing roller 4. Referring to FIG. 2, the sponge roller 3 and developing roller 4 are pressed against each other to form a nip δ. The sponge roller 3 and developing roller 4 rotate in opposite directions. Thus, the larger the nip δ, the greater the frictional force between the sponge roller 3 and developing roller 4 and therefore the higher the charging efficiency. The developing roller 4 is formed of a solid rubber and has a much larger hardness than a sponge rubber 3.

{Operation}

The operation of the image-forming apparatus according to the first embodiment will be described. Referring to FIG. 1, upon receiving a print command from a controller, not shown, a motor, not shown, starts to rotate so that a drive force is transmitted through several gears to a drum gear for rotating the photoconductive drum 7. The rotation of the drum gear transmits the drive force to a developing gear so that the surface of the developing roller 4 rotates in contact with the photoconductive drum 7 in the same direction as the surface of the photoconductive drum 7. The rotation of the developing gear is transmitted to a sponge gear through an idle gear, so that the sponge roller 3 rotates in contact with the developing roller 4 in the opposite direction to the developing roller 4.

The drive force is also transmitted to the transfer roller 8 through a transfer gear, so that the surface of the transfer roller 8 rotates in contact with the photoconductive drum 7 in the same direction as the surface of the photoconductive drum 7. The drive force is also transmitted to the charging roller 9 through a charging gear to the charging roller 9, so that the surface of the charging roller 9 rotates in contact with the photoconductive drum 7 in the same direction as the surface of the photoconductive drum 7.

At substantially the same time that the motor of the printer body starts to rotate, power supplies, not shown, apply predetermined bias voltages to the sponge roller 3, developing roller 4, transfer roller 8, charging roller 9, and cleaning roller 10, respectively.

The charging roller 9 charges uniformly the entire surface of a photoconductive coating on the photoconductive drum 7 uniformly. As the photoconductive drum 7 rotates, the charged surface reaches a position immediately below the LED head 6. The LED head 6 illuminates the charged surface of the photoconductive drum 7 to form an electrostatic latent image on the photoconductive drum 7. As the photoconductive drum 7 further rotates, the electrostatic latent image reaches the developing roller 4. The thin layer of toner is formed on the developing roller 4 by a developing blade 5 and the toner is transferred by the Coulomb force to the electrostatic latent image formed on the photoconductive drum 7, thereby developing the electrostatic latent image into a toner image.

The toner is first deposited on the circumferential surface of the sponge roller 3 formed of a soft resilient material. The sponge roller 3 is pressed against the developing roller 4 under pressure so that the sponge roller 3 is dented to form a nip. The sponge roller 3 and developing roller 4 rotate in opposite directions so that the toner 2 become easy to move. The bias voltages are applied to the sponge roller 3 and developing roller 4 in such a way that the potential difference between the sponge roller 3 and developing roller 4 causes the toner to be transferred from the sponge roller 3 to the developing roller 4.

The sponge roller 3 and developing roller 4 are rotated in opposite directions for the following three reasons. First, the toner 2 can be charged triboelectrically by the friction between areas on the sponge roller 3 and developing roller 4 in contact with each other. Second, residual toner is scratched off the developing roller 4 that has returned through one complete rotation of the photoconductive drum 7. Third, the toner 2 can be uniformly supplied to the developing roller 4.

In the first embodiment, the degree of deterioration of the toner 2 is represented in terms of an amount of unwanted deposition of toner on the photoconductive drum 7 (referred to as "Soiling"). The degree of "soiling" is expressed by a difference between the reflection density (in %) of a white print medium before printing and the reflection density (in %) of a non-printed area of the same white print medium after the print medium has passed through a print engine. For example, for an area on a white print medium that should not be printed, assume that the reflection density (in %) of the print medium is 100% before the print medium has passed the print engine and 98% after the print medium has passed the print engine. Then, the soiling is 2%.

In other words, the larger the amount of unwanted deposition of toner, the more toner is deposited on the print medium. A soiling of 2.5% is detectable, so that human eyes can clearly recognize that there is unwanted deposition of toner in the print medium. Soiling is caused by deterioration of the ability of toner to be charged and therefore indicates a degree of deterioration of toner.

Toner according to the first embodiment is a pulverized toner having a glass transition point lower than 67° C. The developer roller 4 rotates at a circumferential speed higher than 150 mm/sec. In order that the toner is not deteriorated by the friction between the sponge roller 3 and developing roller 4, the sponge roller 3 and developing roller 4 are configured to meet a parameter F defined as follows:

$$F=\theta\times\delta\times Asp\times(Vsp+Vdv) \quad \text{Eq. 1}$$

where θ is an angle of slide (degrees) of the developing roller 4, δ is a nip (mm) formed between the sponge roller 3 and developing roller 4, Asp is a hardness (degrees), Vsp is a circumferential speed (mm/sec) of the sponge roller 3, and Vdv is a circumferential speed (mm/sec) of the developing roller 4.

Asp shows the hardness of the soft, resilient body on the outer circumference of the sponge roller 3 and is commonly a value measured with measured with an Asker Type F durometer (available from KOBUNSHI KEIKI CO., LTD). The other values in Eq. 1 are expressed in the SI unit system (the International System of Units).

Angle of slide θ of the developing roller 4 is another expression of the friction coefficient of the circumferential surface of the developing roller 4. Glass transition point Tg of the toner 2 can be determined with a differential scanning calorimetry DSC-7 available from Perkin-Elmer), the heating rate for the DSC measurement being 80° C./min. The amount of toner measured was 10 mg.

Figure 3:
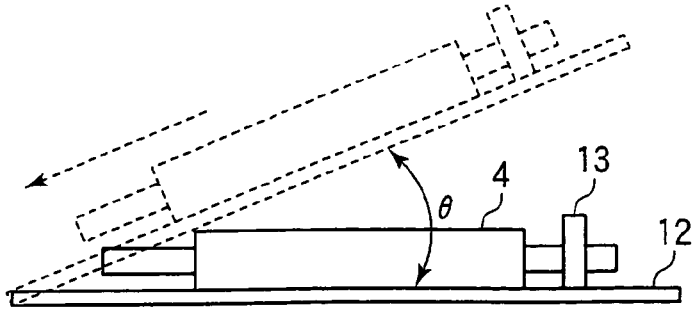
FIG. 3 illustrates an example of measurement of the angle of slide of the developing roller in FIGS. 1 and 2.

FIG. 3 illustrates an example of measurement of the angle of slide of the developing roller 4 in FIGS. 1 and 2. First, the developing roller 4 is placed as shown in solid lines on a horizontal slide stage 12 made of an acrylic plate. The slide stage 12 has a surface roughness Rz of less than 1 μm. The slide stage 12 is gradually lifted at its one end in such a way that the developing roller 4 is raised at its one longitudinal end. The angle that the slide stage 12 makes with a horizontal plane is measured when the developing roller 4 just starts to slide on the slide stage 12 in the longitudinal direction of the developing roller 4. The inclination of the slide stage 12 is the angle of slide θ of the developing roller 4.

The slide stage 12 has cylindrical pins 13 inserted into the slide stage 12 for preventing the developing roller 4 from rolling in its circumferential direction. Because the shaft of the developing roller 4 and the pins 13 have smooth surfaces and extend in directions perpendicular to each other, the pins 13 and the shaft of the developing roller 4 are in a point-contacting relation with each other. Therefore, the friction between the pins 13 and the shaft of the developing roller 4 only creates a negligibly small resistive force when the developing roller 4 slides on the slide stage 12.

Thus, the value of F is a measure that represents a force acting between the developing roller 4 and sponge roller 3. Table 1 lists the experimental values of F.

TABLE 1

| | C 11 | Ex. 11 | Ex. 12 | Ex. 13 | Ex. 14 | Ex. 15 | Ex. 16 | C 12 |
|---|---|---|---|---|---|---|---|---|
| Tg (° C.) | 62 | 56 | 62 | 62 | 56 | 56 | 62 | 62 |
| θ (°) | 33 | 30 | 25 | 30 | 30 | 45 | 39 | 40 |
| δ (mm) | 0.712 | 0.999 | 1.095 | 1.203 | 1.2 | 0.985 | 1.175 | 1.195 |
| Asp | 48 | 45 | 50 | 50 | 45 | 40 | 55 | 54 |
| Vsp (mm/s) | 80 | 70 | 95 | 82 | 92 | 95 | 80 | 84 |
| Vdv (mm/s) | 152 | 152 | 185 | 152 | 185 | 185 | 152 | 152 |
| F | 2.6E+5 | 3.0E+5 | 3.0E+5 | 4.2E+5 | 4.5E+5 | 5.0E+5 | 5.8E+5 | 6.1E+5 |
| Soiling | — | 0.5 | 0.9 | 1.1 | 1.2 | 1.6 | 2.1 | 3.2 |
| melt | — | NONE | NONE | NONE | NONE | NONE | NONE | OCCUR |

Printing was performed on 30,000 pages of A4 size paper using several image-forming apparatus having different values of F, thereby investigating whether the toner melts on the surface of the developing roller 4 and whether soiling occurs. Printing was performed on 30,000 pages of A4 size paper because the image-forming apparatus used in the experiment is capable of printing 30,000 pages before it reaches the end of useful life.

For Comparison #11 having a value of F smaller than $3.0\times10^5$, an acceptable print result was not obtained at the initial stage of initial printing prior to continuous printing, and therefore occurrence of soiling and melting of toner were not investigated. The sponge roller 3 fails to sufficiently charge the developing roller 4, scratch toner off the developing roller 4, and supply a sufficient amount of toner to the developing roller 4 so that the value of F can be considered to be improper.

For Comparison #12 having a value of F larger than $6.0\times10^5$, soiling exceeds 2.5%, and melting of toner occurred on the surface of the developing roller 4. Thus, the value of F can be considered to be improper.

For Examples 11-16, soiling was less than 2.5% and no melting of toner on the surface of the developing roller 4 occurred. Thus, the value of F can be considered to be proper.

For values of F smaller than $3.0\times10^5$ and larger than $6.0\times10^5$, the image-forming apparatus suffers from inadequate endurance in printing or continuous printing. In other words, when the pulverized toner 2 has a glass transition point not higher than 67° C., a value of F properly determined by selecting the positions, circumferential speeds, and materials of the developing roller 4 and sponge roller 3 ensures good results in printing characters and endurance in continuous printing. The value of F is preferably in the following relation.

$$3.0\times10^5<F<6.0\times10^5 \quad \text{Eq. 2}$$

As described above, the first embodiment employs the parameter F as a condition required for preventing melting of toner and toner deterioration that would occur due to the friction engagement of the developing roller 4 with sponge roller 3. The positions, circumferential speeds, and materials of the developing roller 4 and sponge roller 3 can be selected to meet the relation in Eq. 2. Thus, even when a low melting point pulverized toner having a glass transition point Tg not higher than 67° C. is used and the developing roller 4 is rotated at a circumferential speed higher than 150 mm/sec, the toner will not melt to be deposited on the surface of the developing roller, good results in printing characters are obtained, and endurance can still be ensured in continuous printing. Thus, printing speed can be increased even when a toner having a low melting point is used. The use of a toner having a low melting point provides advantages to saving power and miniaturizing the apparatus.

SECOND EMBODIMENT

Pulverized toner has a diameter of about 10 μm but has variations of diameter and composition because the toner particles are manufactured by mechanical pulverization. Further, pulverized toner causes variations in color saturation. In recent years, chemically polymerized toners have become available. Polymerized toner particles have a spherical shape that reduces the torque required for driving the developing roller 4 and sponge roller 3. Further, the uniform diameter of polymerized toner particles enables the uniform saturation of color. A second embodiment will be described with respect to a polymerized toner having a substantially spherical shape.

The configuration of the image forming apparatus, definition of F, the circumferential speed (higher than 150 mm/sec) of a developing roller according to the second embodiment are the same as the first embodiment. The second embodiment differs from the first embodiment in that a polymerized toner having a glass transition point not higher than 67° C. is used. Table 2 lists the experimental values of the parameter F.

TABLE 2

| | C 21 | Ex. 21 | Ex. 22 | Ex. 23 | Ex. 24 | Ex. 25 | Ex. 26 | C 22 |
|---|---|---|---|---|---|---|---|---|
| Tg (° C.) | 63 | 53 | 60 | 53 | 60 | 53 | 60 | 60 |
| θ (°) | 10 | 10 | 20 | 20 | 30 | 25 | 40 | 30 |
| δ (mm) | 0.935 | 1.016 | 0.095 | 1.016 | 0.999 | 1.275 | 0.999 | 1.35 |
| Asp | 40 | 45 | 50 | 55 | 45 | 55 | 45 | 55 |
| Vsp (mm/s) | 90 | 95 | 90 | 95 | 145 | 110 | 145 | 105 |
| Vdv (mm/s) | 176 | 176 | 213 | 176 | 213 | 176 | 213 | 213 |
| F | 9.9E+5 | 1.2E+5 | 2.9E+5 | 3.0E+5 | 4.8E+5 | 5.0E+5 | 6.4E+5 | 7.1E+5 |
| Soiling | — | 0.6 | 0.9 | 1.0 | 1.7 | 1.9 | 2.3 | 3.8 |
| melt | — | NONE | NONE | NONE | NONE | NONE | NONE | OCCUR |

The experiment in the second embodiment was performed under the same conditions as the first embodiment except that a polymer toner having a glass transition point Tg not higher than 67° C. is used.

For Comparison #21 having a value of F smaller than $1.0\times10^5$, the image-forming apparatus failed to provide acceptable results at the initial stage of initial printing prior to continuous printing. Therefore, occurrences of soiling and melting of toner were not investigated. The sponge roller 3 fails to sufficiently charge the developing roller 4, scratch toner off the developing roller 4, and supply a sufficient amount of toner to the developing roller 4 so that the value of F can be considered to be improper.

For Comparison #22 having a value of F larger than $7.0\times10^5$, soiling exceeded 2.5%, and melting of toner occurred on the surface of the developing roller 4. Thus, the value of F can be considered to be improper.

For Examples 2-1 to 2-6, soiling was less than 2.5% and no melting of toner on the surface of the developing roller 4 occurred. Thus, the value of F can be considered to be proper.

For values of F smaller than $1.0\times10^5$ and larger than $7.0\times10^5$, the image-forming apparatus suffers from inadequate endurance in printing or continuous printing. In other words, when the polymer toner 2 has a glass transition point not higher than 67° C., a value of F properly determined by selecting the positions, circumferential speeds, and materials of the developing roller 4 and sponge roller 3 ensures good results in printing characters and endurance in continuous printing. The value of F is preferably in the following relation.

$$1.0\times10^5<F<7.0\times10^5 \quad \text{Eq. 3}$$

As described above, the first embodiment employs the parameter F as a condition required for preventing melting of toner and toner deterioration that would occur due to the friction engagement of the developing roller 4 with the sponge roller 3.

The positions, circumferential speeds, and materials of the developing roller 4 and sponge roller 3 can be selected to meet the relation in Eq. 3. Thus, even when a low melting point polymerized toner having a glass transition point not higher than 67° C. is used and the developing roller 4 is rotated at a circumferential speed higher than 150 mm/sec, good print results are obtained in printing characters and endurance can still be ensured ensures good results and endurance in continuous printing. This enables high-speed printing using a low melting point toner.

Because F can be in a wider range, the condition expressed in Eq. 3 can be achieved more easily than that expressed in Eq. 2. The use of a toner having a low melting point is advantageous in saving power and miniaturizing the apparatus. Polymerized toner is substantially spherical and has a diameter of about 7 μm, which is smaller than a diameter of 10 μm for pulverized toners. Thus, a polymerized toner reduces the torque required for driving the developing roller 4 and sponge roller 3. Further, the uniform diameter of polymerized toner particles implements uniform saturation of color, hence improving printing performance or print quality.

If a pulverized toner can be made substantially spherical by, for example, subjecting the material to additional treatments, such a spherical pulverized toner may also be used.

For example, a capsule type polymerized toner may also be used which the shell has a higher softening point higher than the developer that fills the shell. One such capsule type polymerized toner is a micro capsule type toner having a shell-thickness of several tens nanometers and a shell diameter of 7 μm, available from Japan Zeon. The use of such a micro capsule type toner provides the advantages of a polymer toner and being free of agglomeration of the toner particles that would occur due to heat. Thus, the polymerized toner according to the second embodiment prevents the toner from melting on the developing roller due to the friction between the developing roller 4 and the toner-supplying roller 3.

THIRD EMBODIMENT

A softening point Ts of a low melting point toner can be a measure of how easily the toner can melt.

Tfb can be a measure of how hard the toner particles are. A third embodiment will be described with respect to the use of Tfb and Ts.

The configuration of the image-forming apparatus, the definition of F, the circumferential speed (150 mm/sec) of a developing roller according to a third embodiment are the same as the first embodiment. The third embodiment differs from the first embodiment in that a low melting point pulverized toner having a softening point Ts not higher than 80° C. and a Tfb not higher than 120° C. is used. Ts and Tfb are measures of how easily the toner particles can melt. For example, the model CFT-500C flow tester available from Shimazu Seisakusho, is used to prepare a toner to be tested. The toner is subjected to pressure so that the toner becomes a block having a diameter of 1 cm and a length of 1 cm. Melted toner passes through a dice having a diameter ϕ of 0.5 mm and a length of 1 mm. The toner material is subjected to a pressure of 10 kg and an increase in temperature per unit time of 3° C./min, so that the toner material is initially in a solid state, then a transition state, through a rubbery state, and finally a fluid state, thereby determining Ts and Tfb. Ts is a temperature at which the material transits from a solid state to a transition state. Tfb is a temperature at which a material transits from a rubbery state to a fluid state. Table 3 lists values of F according to the third embodiment.

TABLE 3

| | C 31 | Ex. 31 | Ex. 32 | Ex. 33 | Ex. 34 | Ex. 35 | Ex. 36 | C 32 |
|---|---|---|---|---|---|---|---|---|
| Tg (° C.) | 77 | 77 | 63 | 77 | 63 | 63 | 77 | 77 |
| Tfb (° C.) | 103 | 103 | 119 | 103 | 119 | 119 | 103 | 103 |
| θ (°) | 33 | 30 | 25 | 30 | 30 | 45 | 39 | 40 |
| δ (mm) | 0.712 | 0.999 | 1.095 | 1.203 | 1.2 | 0.985 | 1.175 | 1.195 |
| Asp | 48 | 45 | 50 | 50 | 45 | 40 | 55 | 54 |
| Vsp (mm/s) | 80 | 70 | 95 | 82 | 92 | 95 | 80 | 84 |
| Vdv (mm/s) | 152 | 152 | 185 | 152 | 185 | 185 | 152 | 152 |
| F | 2.6E+5 | 3.0E+5 | 3.8E+5 | 4.2E+5 | 4.5E+5 | 5.0E+5 | 5.8E+5 | 6.1E+5 |
| Soiling | — | 0.5 | 0.9 | 1.1 | 1.2 | 1.6 | 2.1 | 3.2 |
| melt | — | NONE | NONE | NONE | NONE | NONE | NONE | OCCUR |

In the third embodiment, experiment was performed under the same conditions as the first embodiment except that a low melting point pulverized toner having a softening point Ts not higher than 80° C. and a fluid temperature Tfb not higher than 120° C. was used.

For comparison #31 having a value of F smaller than $3.0\times10^5$, the image-forming apparatus failed to provide acceptable results at the initial stage of initial printing prior to continuous printing. Therefore, occurrence of soiling and melting of toner were not investigated. The sponge roller 3 fails to sufficiently charge the developing roller 4, scratch toner off the developing roller 4, and supply a sufficient amount of toner to the developing roller 4, so that the value of F can be considered to be improper.

For Comparison #32 having a value of F larger than $6.0\times10^5$, soiling exceeds 2.5%, and melting of toner occurred on the surface of the developing roller 4. Thus, the value of F can be considered to be improper.

For Examples 31 to 36, soiling was less than 2.5% and no melting of toner on the surface of the developing roller 4 occurred. Thus, the value of F can be considered to be proper.

For values of F smaller than $3.0\times10^5$ and larger than $6.0\times10^5$, the image forming apparatus suffers from inadequate endurance in printing or continuous printing. In other words, when a low melting point pulverized toner having Ts not higher than 80° C. and Tfb not higher than 120° C., a value of F properly determined by selecting the positions, circumferential speeds, and materials of the developing roller 4 and sponge roller 3 ensures good results in printing characters and endurance in continuous printing. In other words, the value of F is preferably in the following relation.

$$3.0\times10^5<F<6.0\times10^5 \quad \text{Eq. 4}$$

As described above, the third embodiment employs the parameter F as a condition required for preventing melting of toner and toner deterioration that would occur due to the frictional engagement of the developing roller 4 with the sponge roller 3.

The positions, circumferential speeds, and materials of the developing roller 4 and sponge roller 3 can be selected to meet the relation in Eq. 4. Thus, even when a low melting point pulverized toner having Ts not higher than 80° C. and Tfb not higher than 120° C. is used and the developing roller 4 is rotated at a circumferential speed higher than 150 mm/sec, good print results are obtained in printing characters and endurance can still be ensured in continuous printing. This enables high-speed printing. The low melting point pulverized toner according to the third embodiment allows saving of power and miniaturizing of the apparatus.

FOURTH EMBODIMENT

Because the toner particles are manufactured by mechanical pulverization, pulverized toner has some variations of diameter and composition. Further, pulverized toner causes some variations in color saturation. In recent years, chemically polymerized toners have become available. Polymerized toner particles have a spherical shape that reduces the torque required for driving a developing roller 4 and a sponge roller 3. Further, the uniform diameter of polymerized toner enables the uniform saturation of color. A fourth embodiment will be described with respect to a low melting point polymerized toner having a substantially spherical shape.

The configuration of the image-forming apparatus, the definition of F, the circumferential speed (higher than 150 mm/sec) of the developing roller 4 according to the fourth embodiment are the same as the third embodiment. The fourth embodiment differs from the third embodiment in that a low melting point polymerized toner having a softening point Ts not higher than 80° C. and a fluid temperature not higher than 120° C. is used. Table 4 lists the experimental values of the parameter F.

TABLE 4

| | C 41 | Ex. 41 | Ex. 42 | Ex. 43 | Ex. 44 | Ex. 45 | Ex. 46 | C 42 |
|---|---|---|---|---|---|---|---|---|
| Ts (° C.) | 68 | 68 | 73 | 68 | 73 | 68 | 73 | 73 |
| Tfb (° C.) | 108 | 108 | 110 | 108 | 110 | 108 | 110 | 110 |
| θ (°) | 10 | 10 | 20 | 20 | 30 | 25 | 40 | 30 |
| δ (mm) | 0.935 | 1.016 | 0.950 | 1.016 | 0.999 | 1.275 | 0.999 | 1.35 |
| Asp | 40 | 45 | 50 | 55 | 45 | 55 | 45 | 55 |
| Vsp (mm/s) | 90 | 95 | 90 | 95 | 145 | 110 | 145 | 105 |
| Vdv (mm/s) | 176 | 176 | 213 | 176 | 213 | 176 | 213 | 213 |
| F | 9.9E+5 | 1.2E+5 | 2.9E+5 | 3.1E+5 | 4.8E+5 | 5.0E+5 | 6.4E+5 | 7.1E+5 |
| Soiling | — | 0.6 | 0.9 | 1.0 | 1.7 | 1.9 | 2.3 | 3.8 |
| melt | — | NONE | NONE | NONE | NONE | NONE | NONE | OCCUR |

In the fourth embodiment, experiment was performed under the same conditions as the third embodiment except that a low melting point polymerized toner having a softening point Ts not higher than 80° C. and a fluid temperature Tfb not higher than 120° C. was used.

For comparison #41 having a value of F smaller than $1.0\times10^5$, the image-forming apparatus failed to provide acceptable results at an initial stage of initial printing prior to continuous printing. Therefore, occurrences of soiling and melting of toner were not investigated. The sponge roller 3 fails to sufficiently charge the developing roller 4, scratch toner off the developing roller 4, and supply a sufficient amount of toner to the developing roller 4, so that the value of F can be considered to be improper.

For Comparison #42 having a value of F larger than $7.0\times10^5$, soiling exceeds 2.5%, and melting of toner occurs on the surface of the developing roller 4. Thus, the value of F can be considered to be improper.

For Examples 41 to 46, soiling was less than 2.5% and no melting of toner on the surface of the developing roller 4 occurred. Thus, the value of F can be considered to be proper.

For values of F smaller than $1.0\times10^5$ and larger than $7.0\times10^5$, the results in Table 4 reveal that the image-forming apparatus suffers from inadequate endurance in printing or continuous printing. In other words, when a low melting point polymerized toner having Ts not higher than 80° C. and Tfb not higher than 120° C., a value of F properly determined by selecting the positions, circumferential speeds, and materials of the developing roller 4 and sponge roller 3 ensures good results in printing characters and endurance in continuous printing. In other words, the value of F is preferably in the following relation.

$$1.0\times10^5<F<7.0\times10^5 \quad \text{Eq. 5}$$

As described above, the fourth embodiment employs the parameter F as a condition required for preventing melting of toner and toner deterioration that would occur due to the frictional engagement of the developing roller 4 with the sponge roller 3. The positions, circumferential speeds, and materials of the developing roller 4 and sponge roller 3 can be selected to meet the relation in Eq. 5. Thus, even when a low melting point polymerized toner having Ts not higher than 80° C. and Tfb not higher than 120° C. is used and the developing roller 4 is rotated at a circumferential speed higher than 150 mm/sec, a value of F properly determined by selecting the positions, circumferential speeds, and materials of the developing roller 4 and sponge roller 3 ensures good results in printing characters and endurance in continuous printing. This enables high-speed printing. This enables high-speed printing. Because F can be in a wider range, the condition expressed in Eq. 5 can be achieved more easily than that expressed in Eq. 4. The use of a toner having a low melting point is advantageous in saving power and miniaturizing the apparatus. Polymerized toner is substantially spherical and has a diameter of about 7 μm, which is smaller than a diameter of 10 μm for pulverized toner. Thus, polymerized toner reduces the torque required for driving the developing roller 4 and sponge roller 3. Further, the uniform diameter and composition of polymerized toner enables uniform saturation of color and hence improves printing performance or print quality.

If a pulverized toner can be made substantially spherical by, for example, subjecting the material to additional treatments, such a spherical pulverized toner may be used.

The use of a capsule type polymerized toner prevents agglomeration of toner particles that would occur due to heat and deteriorating, thereby improving storage characteristic of toner. This also prevents the toner from melting, thereby preventing the toner from becoming attached to the surface of the developing roller 4 due to the frictional engagement of the sponge roller 3 with the developing roller 4.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising:

a toner-supplying roller that rotates;

a developing roller that rotates in contact with said toner-supplying roller and receives toner from said toner-supplying roller, the toner having either a glass transition point not higher than 67° C. or a softening point not higher than 120° C.;

wherein said developing roller and said toner-supplying roller are configured to meet a parameter F such that $$1\times10^5<F<7\times10^5 \text{ and } F=\theta\times\delta\times Asp\times(Vsp+Vdv)$$

where θ is an angle of slide (degrees) of said developing roller,

δ is a nip (mm) formed in said toner-supplying roller in contact with said developing roller, Asp is a hardness (degrees) of a surface of said toner-supplying roller, the hardness being measured with an Asker Type F durometer, Vsp is a circumferential speed (mm/sec) of said toner-supplying roller, and Vdv is a circumferential speed (mm/sec) of said developing roller and is higher than 150 mm/sec.

2. The image-forming apparatus according to claim 1, wherein the toner is a spherical toner having a glass transition point not higher than 67° C.

3. The image-forming apparatus according to claim 2, wherein the toner is chemically polymerized.

4. The image forming apparatus according to claim 3, wherein the toner is a capsule type toner in which the toner particles are enclosed in a shell having a higher softening point than the toner particles.

5. The image-forming apparatus according to claim 1, wherein the toner is a spherical toner having a softening point not higher than 80° C. and a fluid point not higher than 120° C.

6. The image-forming apparatus according to claim 5, wherein the toner is chemically polymerized.

7. The image-forming apparatus according to claim 1, wherein the toner is a pulverized toner having a glass transition point not higher than 67° C., and the parameter F is in the range of $3\times10^5<F<6\times10^5$.

8. The image-forming apparatus according to claim 1, wherein the toner is a pulverized toner having a softening point not higher than 80° C. and a fluid point not higher than 120° C., and the parameter F is in the range of $3\times10^5<F<6\times10^5$.

* * * * *